US007637780B2

(12) United States Patent
Schoene et al.

(10) Patent No.: US 7,637,780 B2
(45) Date of Patent: Dec. 29, 2009

(54) CONNECTOR IN THE FIELD OF TELECOMMUNICATIONS AND A COMBINATION OF AT LEAST TWO CONNECTORS

(75) Inventors: Stefan Schoene, Neuss (DE); Guy Metral, Cluses (FR); Roland Nuiten, Neuss (DE); Juergen Schnusenberg, Neuss (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/997,966

(22) PCT Filed: Aug. 8, 2006

(86) PCT No.: PCT/US2006/030879

§ 371 (c)(1),
(2), (4) Date: Feb. 5, 2008

(87) PCT Pub. No.: WO2007/021684

PCT Pub. Date: Feb. 22, 2007

(65) Prior Publication Data

US 2008/0280493 A1 Nov. 13, 2008

(30) Foreign Application Priority Data

Aug. 12, 2005 (EP) ..... 05017638

(51) Int. Cl.
*H01R 13/66* (2006.01)

(52) U.S. Cl. ..... 439/620.11

(58) Field of Classification Search ..... 439/620.11, 439/676, 941, 660, 76.11
See application file for complete search history.

(56) References Cited

U.S. PATENT DOCUMENTS

| | | | | |
|---|---|---|---|---|
| 4,083,022 | A * | 4/1978 | Nijman | 333/183 |
| 6,176,742 | B1 | 1/2001 | Arnett et al. | |
| 6,186,834 | B1 | 2/2001 | Arnett et al. | |
| 6,402,560 | B1 * | 6/2002 | Lin | 439/676 |
| 6,773,298 | B2 * | 8/2004 | Gutierrez et al. | 439/490 |
| 6,882,248 | B2 * | 4/2005 | Stevenson et al. | 333/182 |
| 6,926,558 | B2 * | 8/2005 | Sasai et al. | 439/620.04 |
| 2004/0092170 | A1 | 5/2004 | Colantuono et al. | |
| 2004/0110422 | A1 * | 6/2004 | Sasai et al. | 439/620 |
| 2007/0112398 | A1 * | 5/2007 | Stevenson et al. | 607/63 |

FOREIGN PATENT DOCUMENTS

GB 2 329 530 A 3/1999

* cited by examiner

*Primary Examiner*—Neil Abrams
*Assistant Examiner*—Phuong Nguyen
(74) *Attorney, Agent, or Firm*—Janet A. Kling; Gregg H. Rosenblatt

(57) ABSTRACT

A connector in the field of telecommunications has connector contacts with at least one bend and at least one capacitor with capacitor leads which are connectable to the connector contacts in the vicinity of the bends of the connector contacts. A combination of at least one such connector and at least one second connector, wherein the second connector acts, in the fitted state, on the connector contacts so as to connect the capacitor leads therewith, is disclosed.

12 Claims, 5 Drawing Sheets

CONNECTOR IN THE FIELD OF TELECOMMUNICATIONS AND A COMBINATION OF AT LEAST TWO CONNECTORS

CROSS REFERENCE TO RELATED APPLICATIONS

This application is a national stage filing under 35 U.S.C. 371 of PCT/US2006/030879, filed Aug. 8, 2006, which claims priority to European Application No. 05017638.7, filed Aug. 12, 2005, the disclosure of which is incorporated by reference in its/their entirety herein.

TECHNICAL FIELD

The invention relates to a connector in the field of telecommunications providing capacitive "cross-talk" reduction, a combination of at least two connectors and a method of connecting a first and a second connector.

BACKGROUND

In the field of telecommunications, and in the field of data transmission and processing, numerous connections are established by telecommunications and/or data lines. These connections can be made by wires, for example copper wires.

Plural wires can be put together at a connector, such as a plug or a socket. By connecting two connectors of this type with each other, plural connections between the wires, which are connected with each of the connectors, are established. Such a type of connection can also be used in networks, such as local area networks, for any connections between devices being part of the network.

In the field of telecommunications and data transmission recent advances in ADSL-technology allow transmission of at least two different signals on a single telecommunications line. This is achieved by transmitting the different signals at different frequencies along the same line. In particular, on the subscriber side, separate voice and data signals are combined and sent to the central office via the same transmission line where it may be split. The voice signal is then directed to the other subscriber(s) on the telephone call, and the data signal is directed to the other subscriber(s) participating in the data exchange. For the transmission of voice and data signals to the subscriber, separate voice and data signals are combined at the central office, sent to the subscriber and split at the subscriber side.

Particularly in connection with ADSL technology, the rates at which telecommunications and data signals are transmitted by telecommunications modules have increased remarkably resulting in increased cross-talk effects. The term "cross-talk" describes an effect in which the contacts of a telecommunications module act as small antennae, which transmit an interfering signal to adjacent contacts. Generally, the interfering signals are transmitted by a pair of wires and, therefore, by a pair of adjacent contacts. Thus, cross-talk between the contacts of a single pair is not an issue. However, cross-talk between the contacts of adjacent pairs should be reduced as far as possible.

The contacts in conventional jack connectors may be in close proximity to one another. If these jack connectors are used in high performance communication systems, cross talk between adjacent conductor pairs may occur.

U.S. Pat. No. 6,176,742 describes a communication connector with a capacitor compensation assembly, in which each capacitor includes a first and a second electrode. The terminals of the electrodes male electrical contact with selected contact wires. However, this contact is made at the free ends of the contact wires. Therefore, large positional tolerances can occur, and the reliability of the electrical connection can be unsatisfactory. This also applies to the subject matter of GB 2 329 530 A and EP 1 160 935 A1.

U.S. 2004/0092170 A1 is related to a connector for data-transfer applications, in which some contacts have extensions formed on them to define capacitors. The extensions require a considerable space. Moreover, the connection between the contacts and the extensions is subject to breakage.

SUMMARY OF THE INVENTION

The invention provides a connector in the field of telecommunications which shows an improved performance with regard to its cross-talk properties, i.e. to reduce cross-talk. Moreover, a combination of two connectors and a method for connecting two connectors are provided.

The connector described herein has connector contacts which may be contained within a housing. Each connector contact has a first end and a second end. The first end of a connector contact is adapted to connect to flexible wires of a communication cable. The second end of a connector contact and/or a portion adjacent thereto typically is adapted to make direct electrical connection with the contact of a complementary connector, for example a plug. For this purpose, the connector contacts can be resilient, and in the fitted state, biased towards the contacts of the complementary connector. In this way, a reliable electrical connection is achieved.

The connector contacts of the connector have at least one bend. The bend can, for example, serve to provide the aforementioned resiliency. Moreover, the bend can assist in keeping the connector compact, because the bend can bring the first contact area, for example on the first end, where wires are attached to the connector contacts, and the second end, where the connector contacts are adapted to make electrical connection with contacts of a complementary connector, close together. Thus, the length of the connector as a whole may be kept small. The bend can, moreover, be used to provide a reliable electrical connection with at least one capacitor.

A capacitor serves to compensate cross-talk which can occur between pairs of contacts in the connector. As will be apparent to those skilled in the art, telecommunications lines are normally arranged in pairs, and cross-talk can occur between adjacent pairs. Moreover, in some applications, the connector contacts of a first pair are in close proximity to the connector contacts of a second pair so that cross-talk is particularly likely to occur between these pairs of contacts. To reduce cross-talk between these pairs, one contact of each pair is connectable with capacitor leads of at least one capacitor. Since a capacitor is normally formed by two parallel plates, the capacitor leads are generally connected with each of the plates.

Since the capacitor leads are connectable with the connector contacts, this connection can be effected by a second connector. Thus, a second connector can, in the fitted state, act on the contacts to connect the capacitor leads.

Accordingly, the invention also provides a method of connecting a first connector with at least one second connector, where the second connector effects the connection between connector contacts and capacitor leads.

BRIEF DESCRIPTION OF THE DRAWINGS

The invention will hereafter be described by non-limiting examples thereof with reference to the drawings in which.

DETAILED DESCRIPTION OF INVENTION

Figure 1:
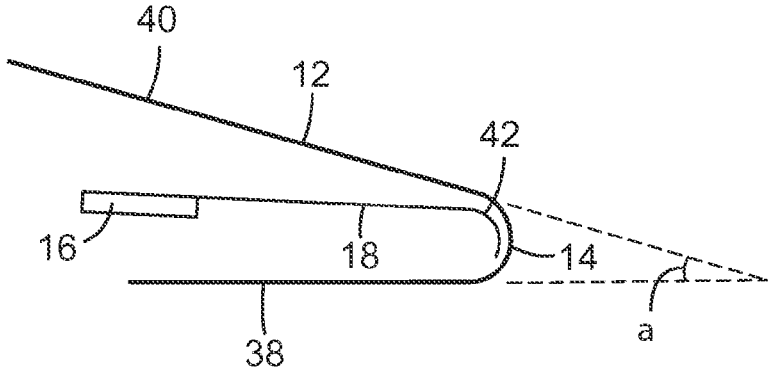
FIG. 1 shows a schematic side view of the contacts of the novel connector.

As described in more detail herein, the invention provides a connector in the field of telecommunications having connector contacts with at least one bend and at least one capacitor with capacitor leads which are connectable to the connector contacts in the vicinity of the bends of the connector contacts.

The connector contacts may be formed in any suitable manner, for example, they can be made of bent or straight sections of wires with, for example, a substantially circular cross-section. Alternatively, the contacts can be stamped from sheet metal in the form of narrow strips of metal which can be bent at one or more locations. For this purpose, wires can be soldered to the connector contacts. As an alternative, they can be wrapped around the connector contacts. It is also possible to crimp a part of each connector contact around a wire. Moreover, the connector contacts can have IDC (insulation displacement contacts) zones, which are adapted to cut the insulation of a wire and make electrical contact with the metal core. Finally, IDC zones can be provided on one or more printed circuit boards, on which printed conductors are provided, which provide a connection between the IDC zones and the connector contacts. For this purpose, the connector contacts are connected, for example soldered, to the printed conductors. Thus, wires are normally connected with first ends of the connector contacts.

Experiments have shown that the connector described herein fulfills category 6, which will be familiar to those skilled in the art. Moreover, data can be transmitted with a band width of 250 MHz.

The capacitor leads of the connector are connectable to the connector contacts. In other words, there is no permanent connection required such as soldering or a similar type of connection. Such connections are, because of mechanical stress, subject to breakage. The capacitor leads, in a first position, can be disconnected from the connector contacts and connected with the connector contacts in a second position. This arrangement can, for example, be adapted for "activation" by a complementary connector. In other words, a complementary connector can, when fitted to a first connector, act on the connector contacts to deform and/or displace the free ends of the connector contacts so that these free ends at least partially move to a position which brings the bent portions of the connector contacts into contact with the capacitor leads to make the desired electrical connection. Thus, at least in the state in which a complementary connector is fitted to a first connector at least one capacitor may be connected with the connector contacts and cross-talk can be reduced. The capacitor leads can also, however, be permanently connected with the connector contacts (i.e. in case of tolerances of the connector contacts) and the capacitor leads relative to each other so that these are in contact before a second connector, (for example a plug) is inserted. The above-described, flexible or disconnectable connection between the capacitor leads and the connector contacts also allows different types of complementary connectors (such as plugs) to be connected with the connector while reliably establishing contact between the connector contacts and the capacitor leads. Moreover, any kind of tolerances at any components of the connector and/or a complementary connector can be compensated and do not affect the electrical contact between the connector contacts and the capacitor leads.

The described electrical connection between the capacitor leads and the connector contacts is established in the general vicinity of the bends of the connector contacts. In other words, these electrical connections can be spaced apart from the free ends of the connector contacts. The reliability of the electrical connection can be improved because positional tolerances, vibrations or the like of the free ends of the connector contacts do not affect the electrical connection with the connector contacts. In particular, the positional accuracy of the connector contacts can be ensured relatively easily and reliably in the vicinity of the bends. Thus, in this area the electrical connection with the capacitor leads is reliably kept. The electrical connection is also not endangered by mechanical stress, which could break a connection formed for example by soldering. Moreover, by using the disconnectable and connectable connection costly production steps such as those necessary for soldering can be eliminated.

The presence of bends in the connector contacts keeps the connector compact and avoids long portions of the connector contacts which can lead to cross-talk effects. The connection with the capacitor is brought close to the area where connection is made with a complementary connector such as a plug. This improves cross-talk compensation. In particular, the electrical connection with the capacitor which is formed in the vicinity of the bends can at the same time be arranged relatively close to those free ends of the connector contacts, where they are adapted to be connected with contacts of a complementary connector. The connectors described herein to not require a printed circuit board for connecting the capacitor leads with the connector contacts. Such a printed circuit board can make the connector complicated and costly. Rather, the electrical connections, in particular between the capacitor and the connector contacts, are directly established through the capacitor leads. It will be understood, however, that in certain applications the connectors described herein can include one or more printed circuit boards. In particular, the connector contacts may, for example, with their aforementioned first end, be inserted into a printed circuit board. Moreover, IDC zones can be provided on the printed circuit board in order to allow the connection of flexible wires with the IDC zones. Finally, printed conductors can be formed on the printed circuit board in order to connect the IDC zones with the connector contacts.

The connector can be formed particularly compact when the at least one bend of the connector contacts has an angle of 90° or less. This, in other words, implies that an acute angle is formed on the connector contacts which keeps the connector compact and provides, as experiments have shown, a reliable connection with the capacitor leads.

The reliability of the electrical connection can also be improved when positional tolerances of the capacitor are limited. This can, for example, be achieved by providing the connector with a contact holder having at least one recess, in which the capacitor is placed. The capacitor can be positioned on the contact holder or any other component of the connector in any other suitable manner, such as by positioning pins, suitable steps, etc. In order to further improve the positioning the connector contacts can be secured to the contact holder. In particular, the above-described recess for accommodating at least one capacitor can be formed in the guides which can serve to position the connector contacts. However, the recess for accommodating the at least one capacitor can also be formed outside the guides. In any case, the guides can be formed by grooves with webs, shoulders, partitions or walls between the grooves. The webs can be formed with a reduced height, at least along some portions, so that a recess is formed on one or more such webs, in which the capacitor can be accommodated.

When a contact holder is present, it can efficiently be used to additionally position the connector contacts. In particular, an efficient structure has been found in a contact holder in which the connector contacts are placed at an inner level and the capacitor is positioned at an outer level. The reliable positioning of the connector contacts and/or the capacitor leads can be further improved if the contact holder has guides in which at least portions of the connector contacts and/or the capacitor leads are arranged.

It has been proved to be an efficient structure of the at least one capacitor, when it has two substantially parallel conductive plates separated by a nonconductive or dielectric layer. The electric charge storing capability of the capacitor (i.e., its capacitance) is determined by the area of the conductive plates, by their separation, or by the properties of the dielectric layer. A capacitor of this type may be formed having plates made from sheet metal or a metallic foil positioned on either side of a dielectric material. Alternatively, the capacitor may comprise a non-metallic foil which is metalized on both sides. Capacitors with this structure can be manufactured in a cost-efficient manner. Using a non-conductive foil or a film as the dielectric provides less variation in the distance between the plates which results in less deviation in the capacitance between different capacitors. In other words, the capacitance can be influenced by choosing an appropriate material and/or an appropriate thickness for the dielectric. For manufacturing the at least one capacitor, it has been found advantageous to use material in the form of a film for the dielectric. Additionally, the capacitance of the capacitor can be set to a predetermined value in a reliable manner and with low tolerances by controlling the surface area of the conductive plates. In one embodiment of the capacitor at least one of the plates of the capacitor extends beyond the other plate on at least one edge thereof. In particular, the plates can be combined in a manner in which a first plate extends beyond a second plate at two opposite edges and the second plate extends beyond the first plate at the other two, opposite edges. Alternatively, the dimensions of one plate can be larger in one or two directions so that the larger plate extends beyond the smaller plate at one or more edge of the smaller plate.

As regards the manufacture of the plates of the capacitor it provides advantages if these are produced by stamping. This type of manufacturing is, firstly, efficient and, secondly, allows the formation of the plates with a high accuracy. Thus, the capacitance of the resulting capacitor can efficiently be set to a predetermined value with low tolerances. Other methods for producing the plates of the capacitor, such as cutting, are possible. However, it has been shown that stamping the plates of the capacitor allows very low tolerances of the resulting capacitors, for example smaller than 0.1 pF.

The assembly of the connector described herein can be facilitated when the capacitor is preassembled and fitted to the connector in the preassembled state. In such a method of assembling the connector described herein it provides advantages when the capacitor has at least one recess or an opening which cooperates with at least one projection formed on the connector. The projection can, for example, be a pin accommodated in an opening formed in the capacitor when the capacitor is fitted to the connector.

As will be apparent, resiliency of the connector contacts and capacitor leads is not necessarily required in order to provide the desired connections of the connector contacts with the capacitor leads. However, the reliability of this connection can be improved when the connector contacts and/or the capacitor leads are flexible. With regard to the connector contacts flexibility or resiliency can, moreover, improve the reliability of the electrical connection with the connector contacts of a complementary connector.

Generally the capacitor leads can have any suitable form. However, it keeps the structure thereof simple when they are formed substantially straight. It provides advantages when the capacitor leads are connectable to the connector contacts at free ends of the capacitor leads. When this connection is formed in the vicinity of bends of the connector contacts, it has proven to be beneficial when the capacitor leads have, for example, at their free ends at least one curved portion. The curved portion can, at least in the connected position, be substantially in conformity with the bend formed on the connector contacts so that a relatively large contact zone is provided in which contact is reliably made.

Generally, the novel connector described herein is not limited to any specific number of connector contacts. However, for specific applications it provides advantages when the connector has eight connector contacts arranged in pairs. The single capacitor, which can be present in such an embodiment, has two capacitor leads which are connectable to a third and a fifth connector contact. In such an arrangement a first and a second connector contact form a first pair, a third and a sixth connector contact form a second pair, a fourth and a fifth connector contact constitute a third pair, and a seventh and an eighth connector contact form a fourth pair. (See EIA/TIA568A)

Whereas the structure of the connector described herein can also be applied to a plug-type connector, it is currently envisaged to form the novel connector as a socket which is adapted to receive a plug.

The connection of at least one capacitor and connector contacts particularly shows when two connectors are connected with each other. Therefore, a combination of at least one connector designed as described herein and a second connector is to be considered subject matter of the present invention.

Corresponding to the novel connector being currently preferably designed as a socket the second, complementary connector-can, for example, be a plug.

As shown in the schematic side view of FIG. 1 (see also FIG. 11), connector contacts 12 of the connector described herein are formed with a bend 14 defining, in the embodiment shown, an acute angle $\alpha$ between a first portion 38 and a second portion 40 of the connector contact 12. The bend 14 is formed curved, rounded or arc-shaped, as shown in FIG. 1. The first portion 38 of the connector contact is adapted for connecting wires (not shown) herewith, as will be described in more detail with reference to FIG. 10, and is, in the embodiment shown, somewhat shorter than the second portion 40. However, the first portion 38 can also have approximately the same length or it can be longer than the second portion 40. The second portion 40 of the connector contact is adapted to establish electrical connection, preferably direct electrical connection, with contacts of a complementary connector (see FIG. 2 for contacts 58 of the complementary connector 36). The capacitor is shown at 16 and comprises capacitor leads, of which only one lead 18 is shown in FIG. 1. The lead 18 is formed substantially straight, somewhat shorter than the first portion 38 of the connector contact, substantially parallel thereto, and has a curved portion 42 at its free end. The curved portion of the capacitor conforms, in the embodiment shown, substantially with the bend 14 of the connector contact and covers an angle of approximately 120°. This angle can also be smaller.

Figure 2:
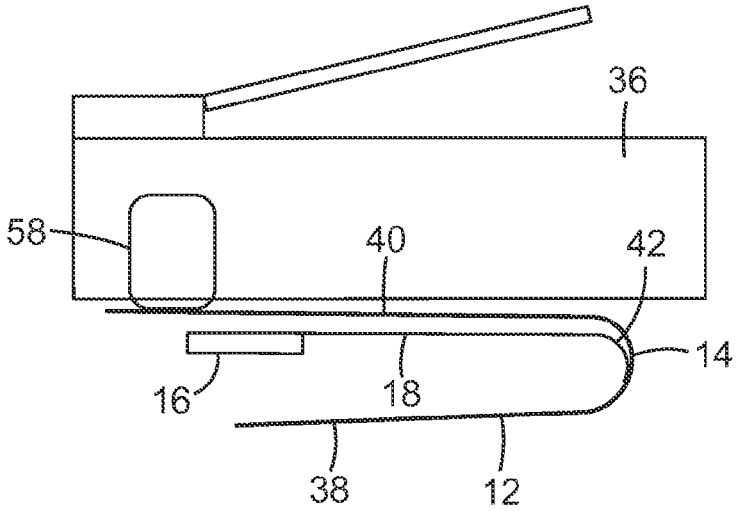
FIG. 2 shows the contacts of FIG. 1 in a state, in which a second connector is fitted to the novel connector.

As shown in FIG. 2, this conformity serves to form a contact zone which, in the embodiment shown, extends for a considerable part of the bend 14 and the curved portion 42. As can particularly be seen in FIG. 2, when a second connector 36 is inserted, this connector acts, in the embodiment shown, to push the second portion 40 of the connector contacts 12 towards the first portions so that these portions are, in the embodiment shown, almost parallel to each other. Naturally, the mentioned portions can also be arranged non-parallel to each other. As the connector contacts 12 are, in the embodiment shown, resilient, they are, firstly, biased towards contacts 58 of the second connector 36 and reliably make contact with these. A reliable electrical contact is, secondly, established with the capacitor leads 18.

Figure 3:
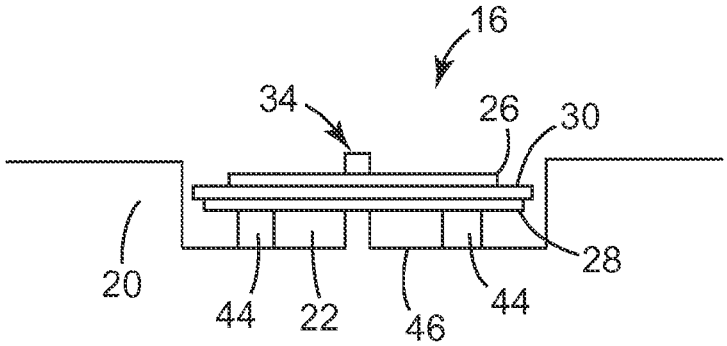
FIG. 3 shows a schematic view of a capacitor in the novel connector.

As shown in FIG. 3 (see also FIG. 11), the capacitor 16 is, in the embodiment shown, constituted by two plates 26, 28 and a dielectric 30 between them. As will be described in more detail below, one of the plates 28 can be larger than the other plate 26. Moreover, the dielectric 30 can be larger than both plates. In the embodiment shown in FIG. 3, the capacitor 16 comprises a hole or an opening (which is not visible in the drawing, the opening 32 is shown in FIGS. 6 to 9), which serves to accommodate a pin 34. The pin 34 is, in the embodiment shown, formed on a contact holder described in more detail below and serves to position the capacitor 16 on the contact holder 20. The contact holder 20 also includes, in the embodiment shown, a recess 22 for accommodating the capacitor 16. Moreover, in the embodiment shown, further projections in the form of webs 44 are present in order to space the capacitor 16 from a wall 46 of the contact holder. Alternatively, one or more webs 44 can be replaced by one or more pillars, pins or similar projections, which act as spacers.

Figure 4:
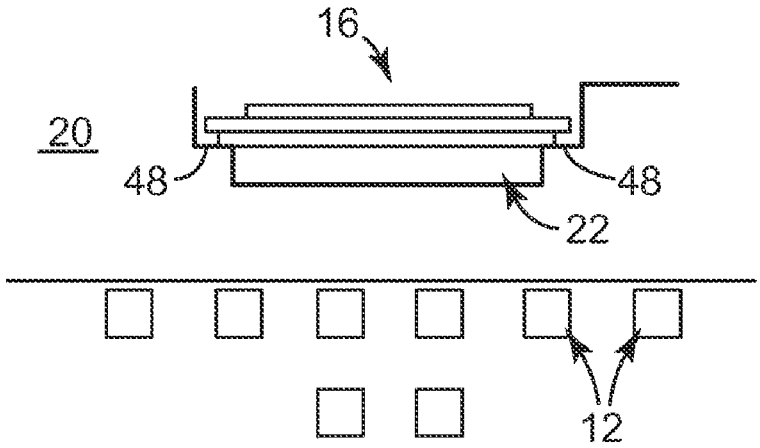
FIG. 4 shows an alternative to the structure of FIG. 3 regarding the arrangement of the capacitor.

FIG. 4 shows an alternative arrangement for the recess 22 formed on the contact holder 20. In this embodiment, steps 48 are provided at the side of the recess 22 in order to locate the capacitor 16. The air, which is present in the recess 22, serves to space the capacitor from the connector contacts, which are schematically indicated in FIG. 4 at 12. This reduces interference between the connector contacts 12 and the capacitor 16.

Figure 5:
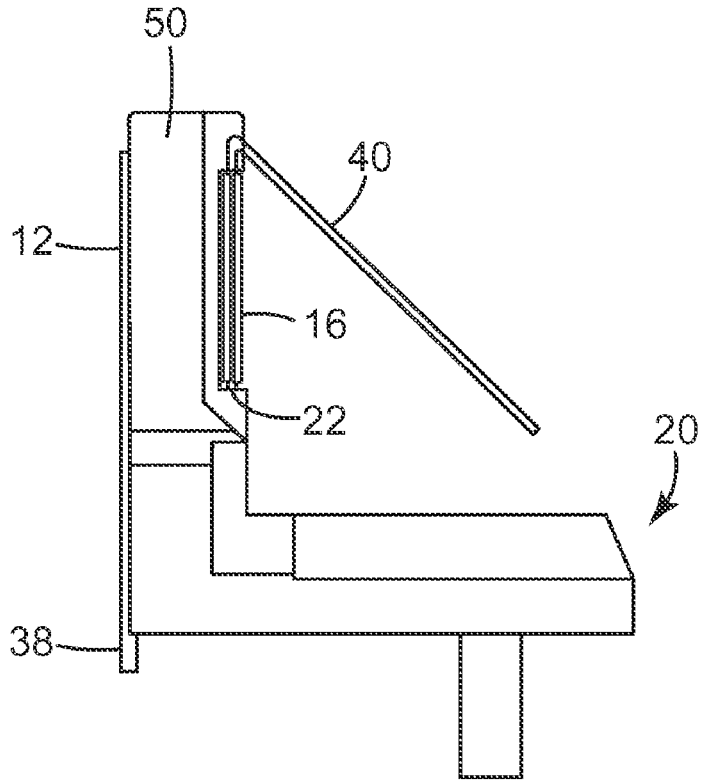
FIG. 5 shows a side view of a contact holder of the novel connector.
Figure 6:
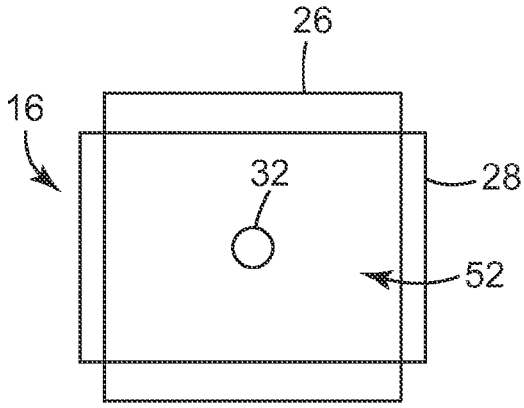
FIG. 6 shows an effective capacitor area of a first embodiment of a capacitor in the novel connector.
Figure 7:
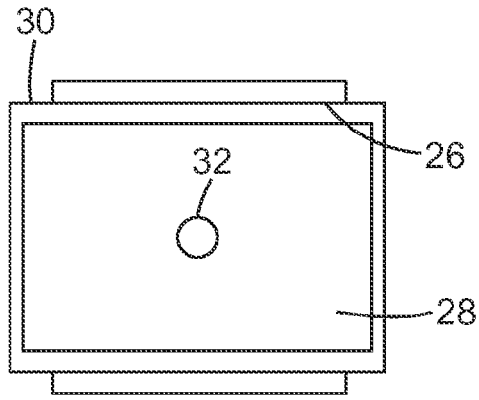
FIG. 7 shows a position of a dielectric in the capacitor shown in FIG. 6.

FIG. 5 shows the complete structure of the contact holder 20, on which the connector contacts 12 are arranged. As can be seen for the first portions 38, at least these portions as well as the bend 14 (see FIG. 1, the bend 14 is hidden behind a wall in FIG. 5) can be arranged in guides 24 formed on the contact holder 20. The guides 24 can be present in form of grooves, which are delimited by webs or walls, one of the walls 50 hiding the bend of the connector contact 12. For accommodating the capacitor 16, a recess 22 is formed in the contact holder, for example, by reducing the height of webs or walls at least along a portion thereof. The contact holder 20 shown in FIG. 5, can be accommodated in a housing (not shown) of the assembled connector.

The remaining figures show two embodiments of the capacitor 16. In the first embodiment shown in FIG. 6 und 7, the capacitor 16 is constituted by two plates 28, 26, which are arranged in a kind of a "cross". In other words, in the embodiment shown, the plates 26, 28 are rectangular, and the longer dimensions of each plate are arranged at a substantially right angle to each other. Thus, the first plate 26 extends beyond the edges of the second plate 28 in the up and down direction according to FIG. 6, and the second plate 28 extends beyond the edges of the first plate 26 in the left and right direction. The effective capacitor is defined by that area, where both plates overlap, and is indicated at 52. As can be taken from FIG. 7, the dielectric 30 is, in the embodiment shown, somewhat bigger than the plate 28. In FIGS. 6 to 9 the opening 32 (in the embodiment shown approximately in the center) of the capacitor 16 is shown, which cooperates with the pin 34 (see FIG. 3).

Figure 8:
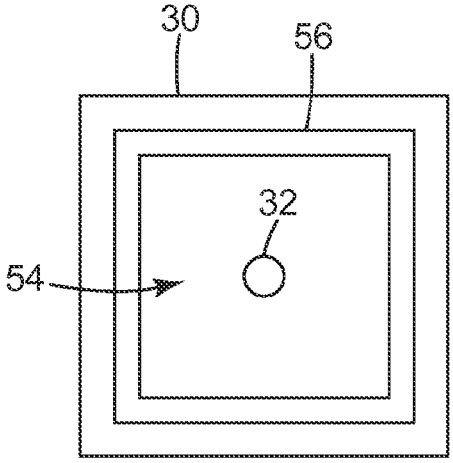
FIG. 8 shows an effective capacitor area of a second embodiment of a capacitor.
Figure 9:
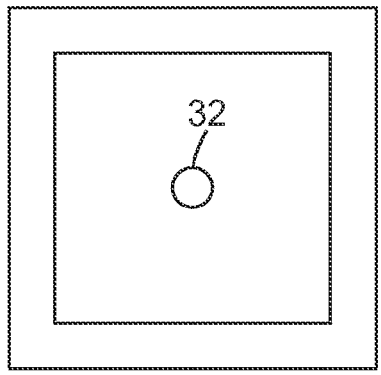
FIG. 9 shows a position of a dielectric in the capacitor of FIG. 8.

In the embodiment of FIG. 8, a first plate 54 is, in two perpendicular directions, smaller than a second plate 56 so that the effective capacitor, i.e., where the plates overlap, is defined by the smaller plate 54 alone because all edges are, in the embodiment shown, substantially parallel. In the embodiment shown in FIGS. 8 and 9, the dielectric 30 is larger than both the smaller plate 54 and the larger plate 56. In the case shown, both plates 54 and 56 and the dielectric 30 are substantially square-shaped.

Figure 10:
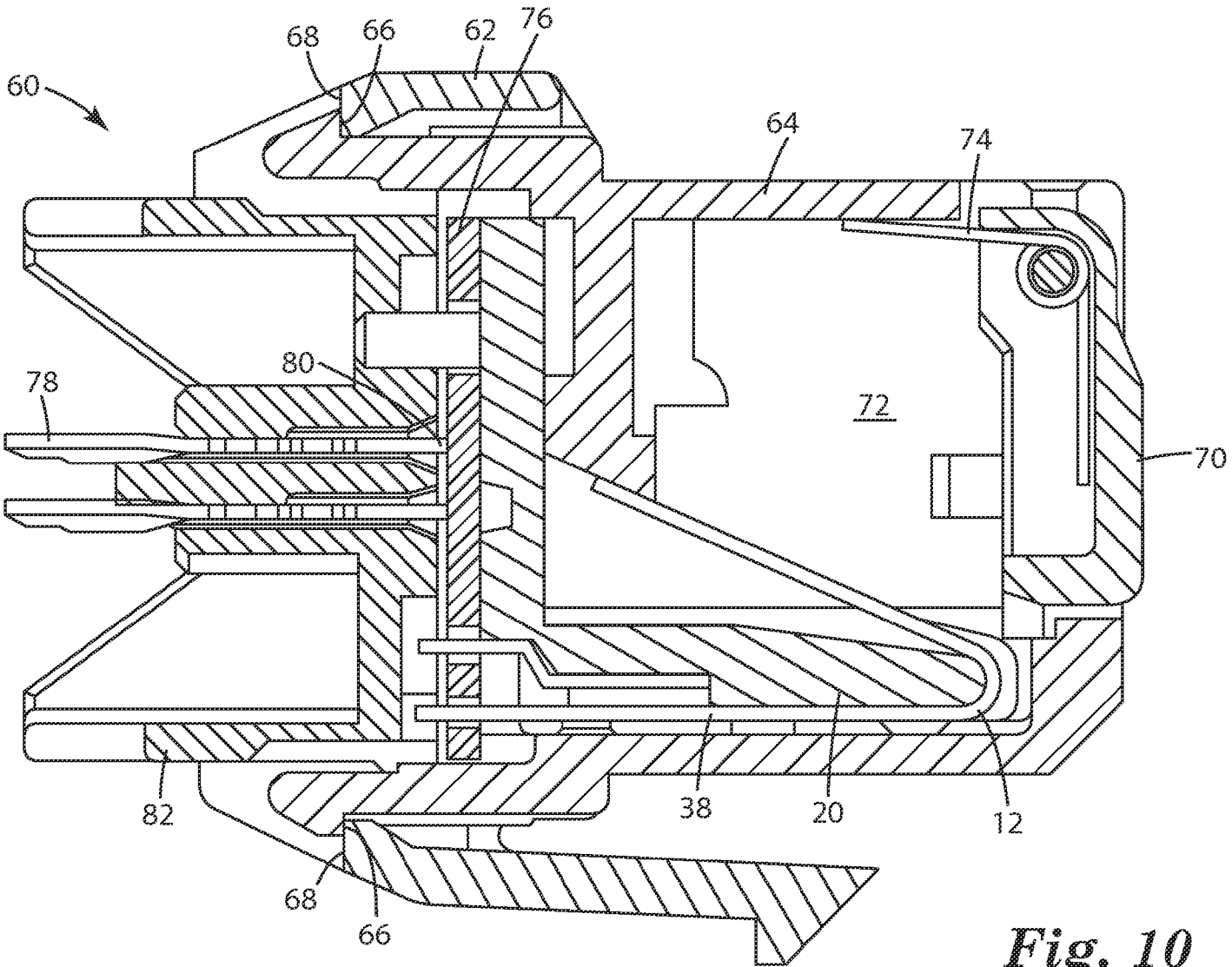
FIG. 10 shows a sectional view of the novel connector in the form of a socket.
Figure 11:
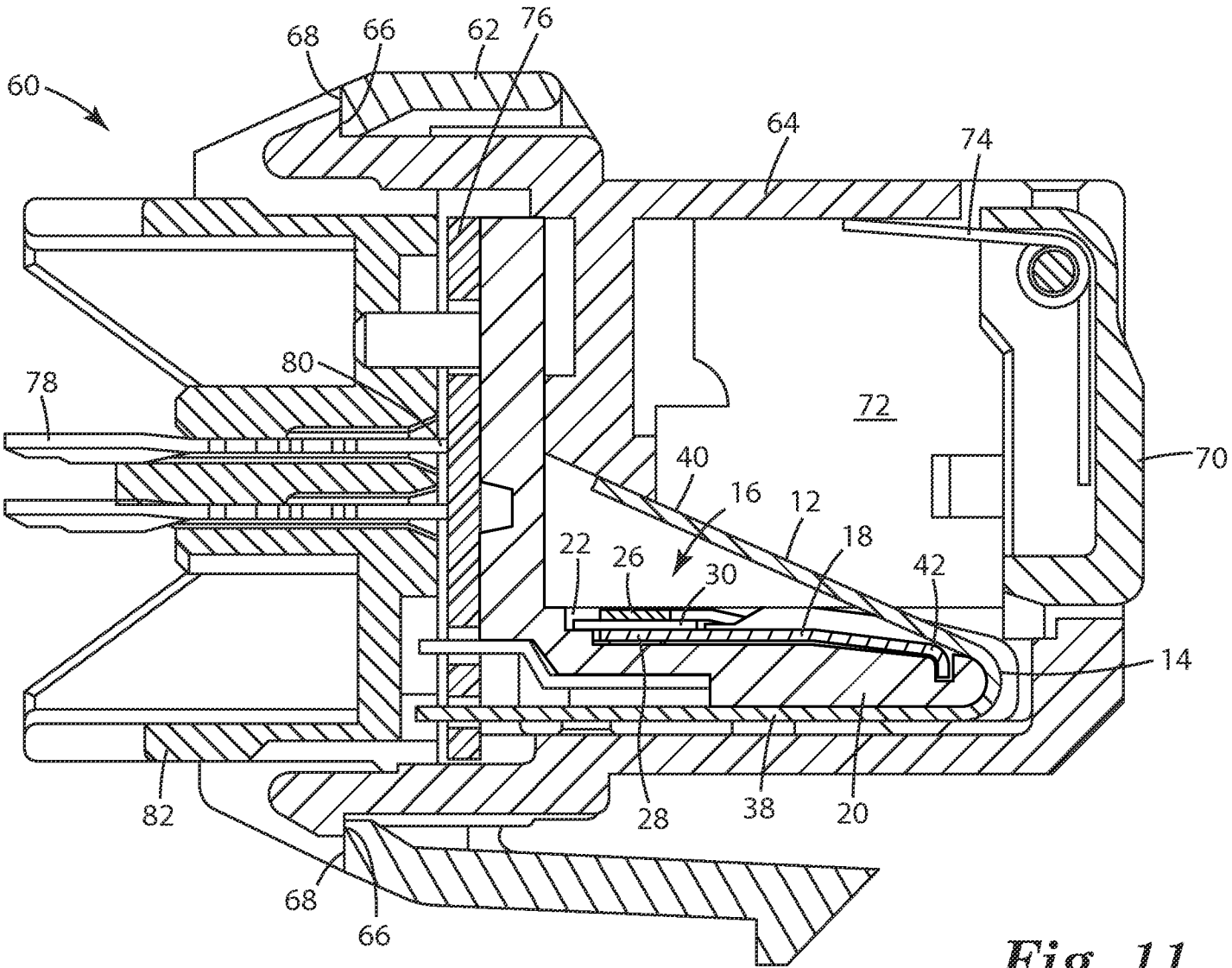
FIG. 11 shows a sectional view of the novel connector in the form of a socket.

FIG. 10 (see also FIG. 11) shows a sectional view of the novel connector in the form of a socket 60. In the embodiment shown, the socket 60 includes a housing which has a first housing part 62 and a second housing part 64. The housing parts 62, 64 are connected with each other by mechanical connections, in the embodiment shown by latch hooks 66 provided on the second housing part 64, which cooperate with suitable shoulders 68 of the first housing part 62. The second housing part 64 includes a flap 70 which can be opened to provide access to the cavity 72 of the socket 60, which is adapted to receive a plug (not shown). A coil spring 74 with two arms is provided to bias the flap 70 to the closed position. The connector contacts 12 are exposed to the cavity 72. In FIG. 10 (see also FIG. 11), the contact holder 20, which has been described in more detail above with reference to FIG. 5, is shown incorporated into the second housing part 64. As compared to the orientation of FIG. 5, the contact holder is apparent in a mirror image and turned 90°.

In the embodiment shown, the socket 60 includes a printed circuit board 76, which includes holes, into which the end of the first portion 38 of the connector contacts 12 is inserted. This end is, for example, pressed into or soldered to the printed circuit board 36, and printed conductors (not shown) are provided in order to make connection with the IDC contacts 78. Ends 80 of the IDC contacts are also inserted into openings of the printed circuit board and, for example, pressed into or soldered to printed conductors. Flexible wires (not shown) can be connected with the IDC contacts 78. Finally, in the embodiment shown, a carrier 82 is provided to support the IDC contacts 78. This is particularly beneficial, before the first 62 and second housing part 64 are mated. In this situation, the printed circuit board 76 is provided on the second housing part 64, and the ends 80 of the IDC contacts are inserted into the printed circuit board 76, when the latch hooks 66 of the second housing part 64 engage the shoulders 68 of the first housing part 62.

The present invention has now been described with reference to embodiments thereof. The foregoing detailed description and embodiment have been given for clarity of understanding only. No unnecessary limitations are to be understood there from. For example, all references to sides, planes and directions are exemplary only and do not limit the claimed invention. It will be apparent to those skilled in the art that many changes can be made to the embodiment described without departing from the scope of the invention. Thus, the scope of the present invention should not be limited to the exact details and structures described herein, but rather by the structures described by the language of the claims and the equivalents of those structures.

The invention claimed is:

1. A connector in the field of telecommunications having a connector contact, wherein the connector contact has a first portion having a free end, a second portion and a bend connecting the first portion and the second portion, and at least one capacitor disposed between the first portion and the second portion of the connector contact, wherein the at least one capacitor includes a capacitor lead having a straight portion and a curved portion at a free end of the capacitor lead, wherein the curved portion of the capacitor lead is connectable to the connector contact in the vicinity of the bend and spaced apart from the free end of the connector contact.

2. The connector in accordance with claim 1 wherein at least one bend has an angle of 90 degrees or less.

3. The connector in accordance with claim 1, wherein the connector includes a contact holder with at least one recess configured to receive the capacitor.

4. The connector in accordance with claim 1, wherein the connector contact and/or the capacitor lead are flexible.

5. The connector in accordance with claim 1, wherein the capacitor lead are connectable to the connector contact at their free ends.

6. The connector in accordance with claim 1, wherein the connector has eight connector contacts, and the capacitor has two capacitor leads which are connectable to a third and a fifth connector contact.

7. The connector in accordance with claim 1, wherein the capacitor leads have a straight portion and a curved portion at their free end, wherein the curved portions of the capacitor leads are connectable to the connector contacts in the vicinity of the bends of the connector contacts.

8. The connector in accordance with claim 1, wherein the curved portion of the capacitor lead is connectable to the bend of the connector contact.

9. The connector in accordance with claim 1 having a contact holder with at least one recess, in which the capacitor is placed.

10. The connector in accordance with claim 9, wherein the contact holder has guides for the connector contact and/or the capacitor lead.

11. A combination of at least one first connector in accordance with claim 1 and at least one second connector.

12. The combination in accordance with claim 11, wherein the second connector acts, in the fitted state, on the connector contacts so as to connect the capacitor leads therewith.

* * * * *